US006875166B2

(12) United States Patent
Kroll et al.

(10) Patent No.: US 6,875,166 B2
(45) Date of Patent: Apr. 5, 2005

(54) METHOD FOR CREATING A COUPLING BETWEEN A DEVICE AND AN EAR STRUCTURE IN AN IMPLANTABLE HEARING ASSISTANCE DEVICE

(75) Inventors: Kai Kroll, Minneapolis, MN (US); Ann M. Gronda, New Brighton, MN (US); Mike Schugt, St. Paul, MN (US)

(73) Assignee: St. Croix Medical, Inc., Minneapolis, MN (US)

( * ) Notice: Subject to any disclaimer, the term of this patent is extended or adjusted under 35 U.S.C. 154(b) by 0 days.

(21) Appl. No.: 10/422,508

(22) Filed: Apr. 24, 2003

(65) Prior Publication Data

US 2004/0039244 A1 Feb. 26, 2004

Related U.S. Application Data

(63) Continuation-in-part of application No. 09/947,739, filed on Sep. 6, 2001, now Pat. No. 6,592,513.

(51) Int. Cl.[7] ..... H04R 25/00
(52) U.S. Cl. ..... 600/25; 381/312
(58) Field of Search ..... 600/25, 559; 128/898; 607/55–57; 623/10; 181/126, 129, 130, 134, 135; 381/69, 312–331

(56) References Cited

U.S. PATENT DOCUMENTS 5,259,032 A 11/1993 Perkins et al.
6,077,215 A 6/2000 Leysieffer
6,139,488 A 10/2000 Ball
6,162,169 A 12/2000 Leysieffer
6,171,229 B1 * 1/2001 Kroll et al. ..... 600/25
6,592,513 B1 * 7/2003 Kroll et al. ..... 600/25

OTHER PUBLICATIONS

*The American Journal of Orology* 19;693–699 1996. The American Journal of Otology, Inc. "Tympanoplasty Type II With Ionomeric Cement and Titanium–Gold–Angle Prostheses", Marcus M. Maassen and H. Peter Zenner, Department of Orolaryngology, University of Tuebingen, Tibingen, Germany.

* cited by examiner

*Primary Examiner*—Samuel G. Gilbert
*Assistant Examiner*—Nikita R. Veniaminov
(74) *Attorney, Agent, or Firm*—Natalie D. Kadievitch; Fredrikson & Byron, P.A.

(57) ABSTRACT

A method for creating a coupling between an implantable device, such as a transducer, and a structure of the ear, such as an ossicle, in an implantable hearing assistance device. The coupling permits slip between the device and the structure and provides a neutral load. The device is positioned such that it either lightly touches or is positioned away from the structure. In one embodiment, the surface of the device or the structure is cleaned while the remaining surface, that is, the surface not cleaned, is coated with a solution. An adhesive material is applied between the device and the structure. The solution prevents a bond from forming at that interface while a bond forms at the remaining surface. Alternatively, a compliant adhesive may be used. In another embodiment, the surface of the device is coated with a gel, the gel optionally being covered with a metallic foil.

35 Claims, 8 Drawing Sheets

METHOD FOR CREATING A COUPLING BETWEEN A DEVICE AND AN EAR STRUCTURE IN AN IMPLANTABLE HEARING ASSISTANCE DEVICE

PRIORITY

This is a Continuation-in-Part of application Ser. No. 09/947,739 filed Sep. 6, 2001, now U.S. Pat. No. 6,592,513 B1, issued Jul. 15, 2003, entitled Method for Creating a Coupling Between a Device and an Ear Structure in an Implantable Hearing Assistance Device.

BACKGROUND OF THE INVENTION

1. Field of the Invention

This invention relates to implantable hearing assistance systems for hearing impaired persons, and in particular, to a method of creating a coupling between an implantable component and a structure of the ear.

2. Description of Related Art

In a patient with normally functioning anatomical hearing structures, sound waves are directed into an ear canal by the outer ear and into contact with the tympanic membrane. The tympanic membrane is located at the terminus of the ear canal. The pressure of the sound waves (acoustic sound energy) vibrates the tympanic membrane resulting in the conversion to mechanical energy. This mechanical energy is communicated through the middle ear to the inner ear by a series of bones located in the middle ear region. These bones of the middle ear are generally referred to as the ossicular chain, which includes three primary structures, the malleus, the incus and the stapes. These three bones must be in functional contact in order for the mechanical energy derived from the vibration of the tympanic membrane to be transferred through the middle ear to the inner ear. If these three bones do not effectively communicate the mechanical energy through the middle ear, the patient suffers from a conductive hearing loss.

Various implantable devices have been developed to assist the hearing impaired patient. Some implantable hearing assistance systems use an acoustic microphone located in or near the ear to convert acoustic sound energy into an electrical signal. The electric signal is amplified, modulated, and then directly communicated by an output transducer to the inner ear to stimulate the cochlea to assist in hearing. Alternatively, the amplified signal is communicated to a transducer for conversion to mechanical energy for vibratory application to the stapes or cochlea. The microphone may be located externally, subdermally adjacent the ear, or within the external auditory canal. The output transducer is commonly connected to the ossicular chain. Vibrations are emitted from the output transducer into and through the ossicular chain to the cochlea.

Other implantable devices include partial middle ear implantable or total middle ear implantable devices, cochlear implants, and other hearing assistance systems that use components disposed in the middle ear or inner ear regions. These components may include an input transducer for-receiving sound vibrations or an output transducer for providing mechanical or electrical output stimuli based on the received sound vibrations. Piezoelectric transducers are one example of a class of electromechanical transducers that require contact to sense or provide mechanical vibrations. For example, the piezoelectric input transducer in U.S. Pat. No. 4,729,366, issued to D. W. Schaefer on Mar. 8, 1988, contacts the malleus for detecting mechanical vibrations. In another example the piezoelectric output transducer in the '366 patent contacts the stapes bone or the oval or round window of the cochlea.

Devices for assisting the hearing impaired patient range from miniaturized electronic hearing devices that may be adapted for placement entirely within the auditory canal, or implantable devices which may be completely or partially implanted within the skull. For those hearing systems, or portions of hearing systems, designed for complete subcranial implantation, a challenge has existed to adapt the implantable device for optimal mounting to the unique patient morphologies (including both naturally occurring as well as those created by surgical processes) among patients. Known implantable devices having elements that perform a support or mounting function are typically rigidly mounted to a bone within the middle ear region. Difficulties have arisen with the use of implantable devices in facilitating the fine adjustments necessary to properly position and configure the support assembly and attached transducers so as to contact an auditory element and thus vibrate a portion of the ossicular chain. Such devices present a particular problem in that positioning, or docking, of the transducer against the auditory element in this stable configuration requires extremely fine adjustments that are difficult given the location of the auditory elements and the attendant's lack of maneuvering room.

A middle ear implantable hearing assistance system typically includes, at least, an input device, such as a sensor transducer, an output device, such as a driver transducer, an electrical connection between the devices and a coupling of at least one of the devices to an element of the middle ear. Typically, the coupling between a transducer and the middle ear element is mechanical. The transducer communicates with the middle ear element via the mechanical coupling and the mechanical coupling is, therefore, critical to the efficacy of the hearing aid system. Proper positioning of the transducer and good contact between the transducer and ossicle is essential to properly transducing the received mechanical energy into a resulting electrical signal for hearing assistance processing.

There is a need in the art to ascertain whether too much force between the transducer and the ossicle, for example the malleus, may mechanically load the vibrating ossicle and attenuate the desired mechanical vibration signal or alter its frequency characteristics. It may be that, in an extreme case, too much force may damage or break either the ossicle or the transducer. It is also possible that too little force between the transducer and the ossicle may be insufficient to detect the mechanical vibration signal, and result in a complete loss of signal detection if the transducer and the ossicle become dissociated.

It is desirable for a device to accommodate the morphology of the ossicle or tissue which it is connecting (directly or indirectly) as opposed to devices of the prior art that do not take into account the morphological differences of each patient. Such prior art devices either harm the patient by not taking into account, fully, the detrimental impact on tissue patency caused by its structural method of attachment, are nonfunctional, or lose functioning ability with drops of pressure. Specifically, when a transducer is too loosely coupled to the ossicle, there is no signal and, conversely, when a transducer is too tightly coupled to the ossicle, there may be a less than optimum frequency response or harm to the tissue.

Prior art coupling mechanisms used, for example, in coupling a transducer to an ossicle, have a variety of problems. Typically, biasing, crimping, or adhesives have been used to attach to an ossicle. Biasing may result in a connection which is too loose because of the difficulty in determining the extent of the biasing. Over a patient's lifespan, muscles, tissue, and ligaments may stretch and cause the biasing to become loose. Additionally, even if the biased element is not loose during everyday activity, it may become loose and lose contact altogether with a change in pressure, such as in an elevator or an airplane. Crimping has similar problems. It is difficult to determine when the element has been adequately crimped to the ossicle. If the element is too tightly crimped to the ossicle, the blood vessels lose patency and bone rotting may occur. If the element is too loosely crimped to the ossicle, there may be resonances and a poor frequency response.

Adhesives, as well, have evidenced problems in coupling a transducer to an ossicle. One problem associated with adhesives is that, although affecting good fixation to the ossicle without damaging the ossicle, the hard fix of the transducer to the ossicle can inhibit natural movement of the ossicle. The ossicular elements of the middle ear have a complex range of motion. Specifically, each ossicle has yaw, pitch, and roll movement. When a device is coupled to the ossicle with hard fixation, at least one range of movement tends to be limited. This can attenuate, for example, the vibrations sensed by an input transducer and, therefore, decrease the efficacy of the implantable hearing assistance device.

Similar problems occur when coupling an ossicle to a passive prosthesis. A passive prosthesis is used when one or more of the malleus, incus, or stapes is partially or completely removed or damaged. The passive prosthesis maintains functional contact to transfer the mechanical energy derived from the vibration of the tympanic membrane through the middle ear to the inner ear.

SUMMARY OF THE INVENTION

The present invention provides a method of creating a coupling between an implantable component and a structure of the ear. Specific description is given to a coupling between a transducer of an implantable hearing assistance system and a middle ear ossicle. However, the method is equally suited to creating a coupling between any implantable device, for example a prosthesis, to an ear structure such as an ossicle.

The method of the present invention involves creating a coupling using an adhesive to fix the device, for example a transducer tip, to an ear structure, for example an ossicle. In one embodiment, a liquid solution may be used to inhibit bonding of the adhesive material to either the device or the structure (or, if a liquid is not used, breaking the bond between the device and the structure). The surface tension of the liquid between the adhesive and the ossicle (or, alternately, between the adhesive and the device) holds the ossicle (or device) tightly in position but permits slip. In another embodiment, the device (for example, the transducer tip), is coated with a gel. The gel may be covered with a foil to permit bonding of the device to the structure.

Typically the implantable hearing device will include at least one of an input transducer or an output transducer. The input or output transducer is mechanically coupled to an ossicle of the middle ear. The transducer generally includes a probe tip that extends from the transducer housing to contact the ossicle. For ease of discussion, specific reference will be made to an input transducer.

The present invention provides positioning the tip of a transducer such that it either lightly touches the ossicle or is spaced between a fraction of a millimeter to a few millimeters above the ossicle. A preferred spacing is between ¼ and one millimeter. The tip of the transducer may be washed and suctioned such that its surface is as dry and clean as possible. In contrast, the surface of the ossicle may be coated with a thin layer of solution. The solution is preferably applied in sufficient amount to cover the surface.

In one embodiment, an adhesive material is applied to the space between the tip and the ossicle to create mechanical coupling between the transducer and the ossicle. The adhesive may be a non-compliant (that is, hard) adhesive or a compliant adhesive. The adhesive material creates a bond at its interface with the transducer tip because the dry surface of the tip allows mechanical and/or chemical bonding thereto. A thin layer of solution on the surface of the ossicle may optionally be used to prevent the adhesive from forming a mechanical or chemical bond at the interface between the ossicle and the adhesive. If the formation of a bond at the ossicle/adhesive interface is prevented, the coupling does not inhibit the natural motion of the ossicle. Similarly, using a compliant adhesive permits the natural motion of the ossicle. The adhesive attached to the tip molds to the shape of the ossicular surface and thereby forms a molded coupling that provides a neutral load but permits slip between the transducer and the ossicle.

Alternately, the surface of the ossicle may be washed and suctioned dry. The surface of the transducer tip is wet with solution and the adhesive is applied between the surface of the ossicle and the transducer tip. In this embodiment, a mechanical and/or chemical bond forms at the ossicle/adhesive interface but not at the tip/adhesive interface.

Yet another embodiment of the invention involves applying an adhesive between the ossicle and the transducer tip and breaking the bond formed therebetween by gently separating the tip from the ossicle.

In another embodiment, a hydrogel, thermally or chemically activated gel may be used. The gel is bonded to the transducer, preferably at the transducer tip, and expands to encapsulate the ossicle. Thus, the gel applied to the outside of the transducer (or other device) is either hydrated or chemically expanded to make contact with the ossicle. Further, a compliant material (e.g. silicone, gel or other) on the transducer tip may be covered with a metallic foil or similar material to permit bonding of the tip to the ossicle using a non-compliant adhesive. In this embodiment the gel does not expand to encapsulate the ossicle but acts as a compliant material between the foil and the pin. A hard adhesive may then be used to couple the foil to the ossicle. The silicone or gel accommodates small changes in position relative to the ossicle and the transducer and maintains a near-neutral bias.

The method of the present invention optimizes creating a coupling using an adhesive by inhibiting the bond of the adhesive to the ossicle, by using a compliant adhesive, or by using a gel. Each of these embodiments permit slip between the ossicle and the transducer and therefore does not inhibit the natural movement of the ossicle. Further, the coupling allows a neutral load rather than biasing the tip to the ossicle.

BRIEF DESCRIPTION OF THE DRAWINGS

Embodiments of the invention will be described with reference to the figures, in which like-referenced numerals denote like elements.

DETAILED DESCRIPTION OF THE PREFERRED EMBODIMENTS

The invention provides an apparatus and method for damping vibrations in a mounting bracket assembly supporting an output transducer of an implantable hearing assistance system. Such a hearing assistance system augments the human auditory system in converting acoustic energy contained within sound waves into electromechanical signals delivered to the brain and interpreted as sound. Minimization of the undesired vibratory effect of the transducer back through component parts of the assembly improves the gain of the hearing assistance system, impairing increased hearing ability to the patient. This minimization is accomplished by providing a damping mechanism integral to the support assembly of the output transducer or, alternately, by providing a second transducer with an offsetting mass or spring or by providing a spring affixed to the support assembly.

Figure 1:
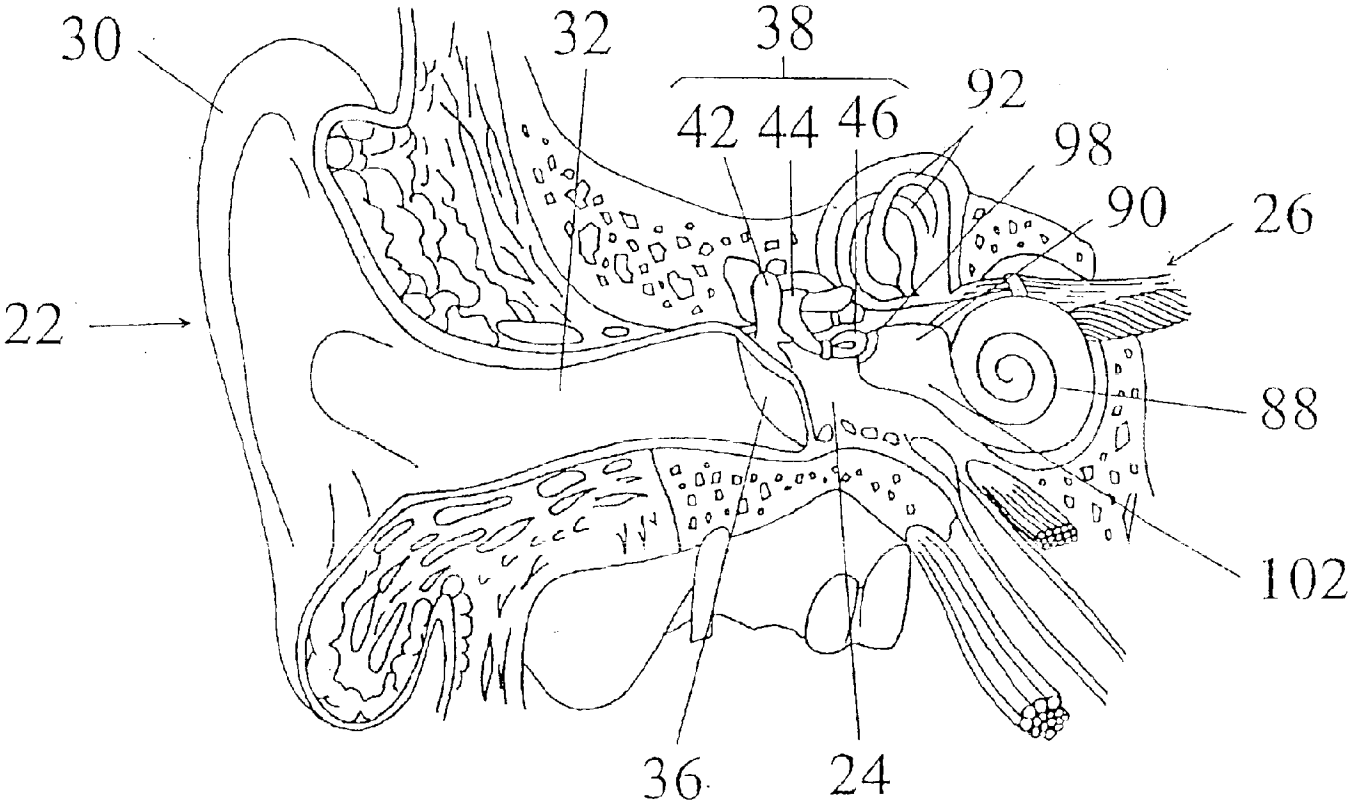
FIG. 1 illustrates a frontal section of an anatomically normal human right ear in which the invention operates.

The ear is the auditory organ of the body through which sound waves are delivered to the brain. FIG. 1 illustrates generally the situs for use of the invention in a human ear. The ear 20 includes the outer ear 22, the middle ear 24, and the inner ear 26. The outer ear 22 includes the pinna 30 and the exterior auditory canal. The exterior auditory canal extends through the mastoid 34.

The middle ear 24 begins at the interior terminus of the exterior auditory canal 32. The middle ear 24 includes the tympanic membrane 36 and the ossicular chain 38. The ossicular chain 38 includes the malleus 42, the incus 44, and the stapes 46.

Figure 2:
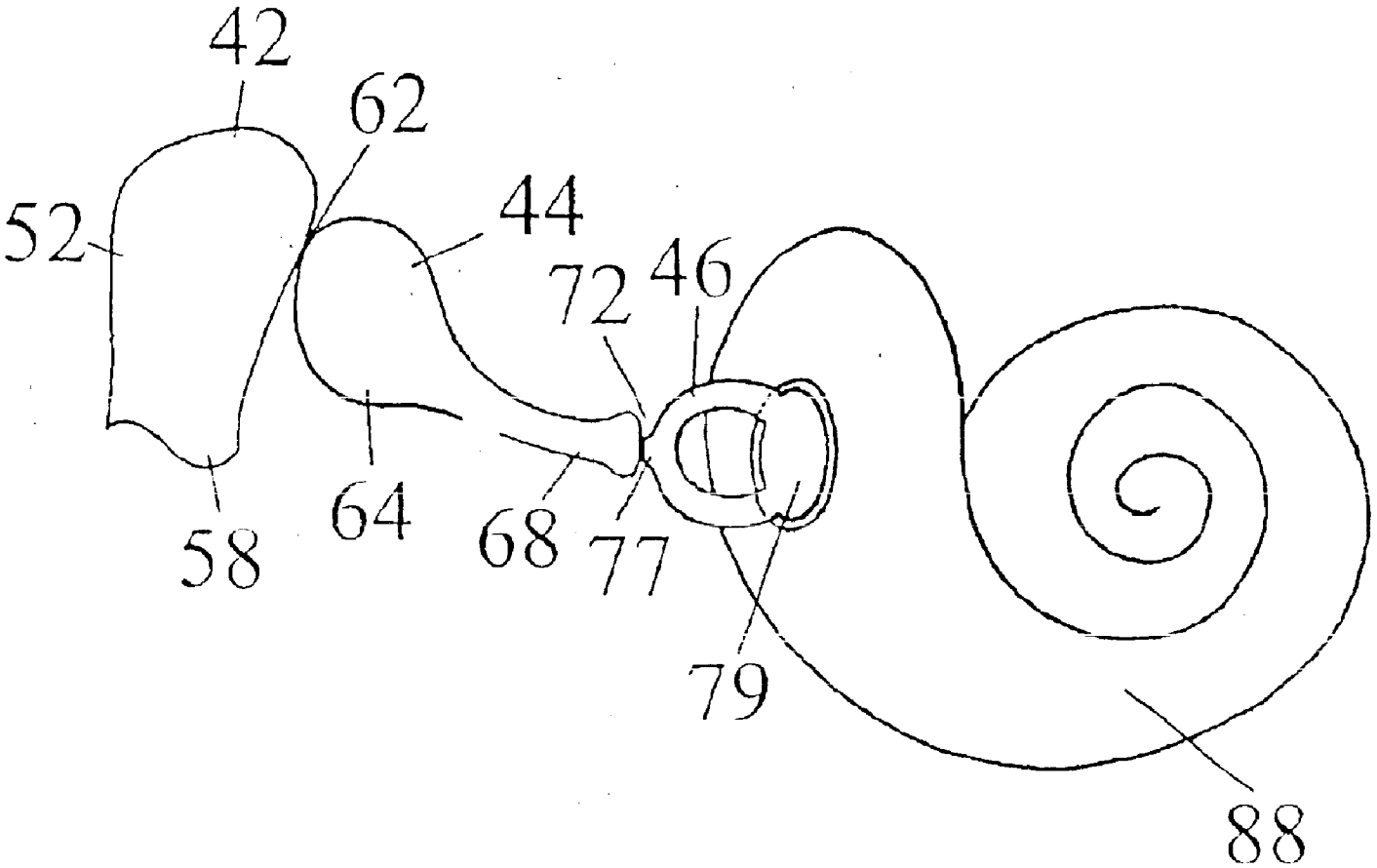
FIG. 2 is a detailed view of the ossicular chain within the middle ear as illustrated in FIG. 1.

As best seen from FIG. 2, the malleus 42 includes a head 52, a lateral process 54, an anterior process 56, and a manubrium 58. The malleus 42 attaches to the tympanic membrane 36 at the manubrium 58. The incus 44 articulates with the malleus 42 at the incudomalleolar joint 62 and includes a body 64, a short crus 66, and a long crus 68. The stapes 46 articulates with the incus 44 at the incudostapedial joint 72 and includes a posterior crus 74, an anterior crus 75, a capitulum 76, and a base (front plate) 79. The capitulum 76 of the stapes 46 includes a head 77 and a neck 78.

The base of stapes 46 is disposed in and against a portion of inner ear 26. The inner ear 26 includes a cochlea 88, a vestibule 90, and a semicircular canal 92. The base 79 of the stapes 46 attaches to the oval window 98 on the vestibule 90. The round window 102 is present on a more basal portion of the vestibule 90. The oval window 98 and the round window 102 are herein considered a portion of the cochlea 88.

Sound waves are directed into the external auditory canal 32 by the outer ear 22. The frequencies of the sound waves may be slightly modified by the resonant characteristics of the exterior auditory canal 32. These sound waves impinge upon the tympanic membrane 36, thereby producing mechanical tympanic vibrations. The mechanical energy of the tympanic vibrations is communicated to inner ear organs the cochlea 88, the vestibule 90, and the semicircular canals 92 by the ossicular chain 38.

Normally, tympanic vibrations are mechanically conducted through the malleus 42, the incus 44 and the stapes 46 to the oval window 98. Vibrations at the oval window 98 are conducted into the fluid-filled cochlea 88. The mechanical vibrations generate fluidic motion, thereby transmitting hydraulic energy within the cochlea 88. Receptor cells in the cochlea 88 transmit the fluidic motion into neural impulses, which are transmitted to the brain and perceived as sound. Pressures generated in the cochlea 88 by fluidic motions are also accommodated by the round window 102. The round window 102 is a second membrane-covered opening between the cochlea 88 and the middle ear 24.

Hearing loss due to damage in the cochlea 88 is referred to as sensorineural hearing loss. Hearing loss due to an inability to conduct mechanical vibrations through the middle ear 24 is referred to as conductive hearing loss. Some patients have an ossicular chain 38 which lacks resiliency. Ossicular chains with insufficient resiliency are either inefficient or totally fail to transmit mechanical vibrations between the tympanic membrane 36 and the oval window 98. As a result, fluidic motion in the cochlea 88 is attenuated and the receptor cells in the cochlea 88 fail to receive adequate mechanical stimulation. Damaged or missing elements of the ossicular chain 38, of course, may further interrupt transmission of mechanical vibrations between the tympanic membrane 36 and the oval window 98.

Hearing assistance systems are used to convert acoustic sound energy into an electric signal which may be amplified and applied to an ossicular element as mechanical energy. Implantable systems often convert the mechanical vibrations caused by the acoustic sound energy vibrating an ossicle to an electrical signal with an input transducer. The electrical signal is then processed and transmitted to another ossicle as mechanical energy by an output transducer. Any deficiency in the ossicular chain is thereby compensated for or bypassed. Alternately, of course, an acoustic microphone may be used to convert acoustic energy in lieu of an input transducer converting mechanical energy.

The ossicular chain facilitates forward transmission of mechanical sound vibrations from the tympanic membrane to the inner ear. However, reverse transmission of mechanical energy from a transducer of the implantable hearing assistance system, back through the ossicular chain, to the temporal bone and to a second transducer of the implantable hearing assistance system also occurs. This retrograde sound transmission negatively affects the quality of sound produced by the system and system effectiveness. A feedback barrier may be used to minimize or damp the vibratory feedback.

This feedback barrier is preferably implemented by interrupting the ossicular chain 38. Alternatively, preventing movement of the ossicular chain 38 or otherwise isolating the transducer from mechanical/acoustic feedback through the ossicular chain 38 may also provide the necessary barrier. Disarticulation or anchoring of the ossicular chain 38, however, does not prevent signal feedback from the transducer, through the support assembly, into the mastoid 34, and to other areas within the middle ear 24.

Figure 3:
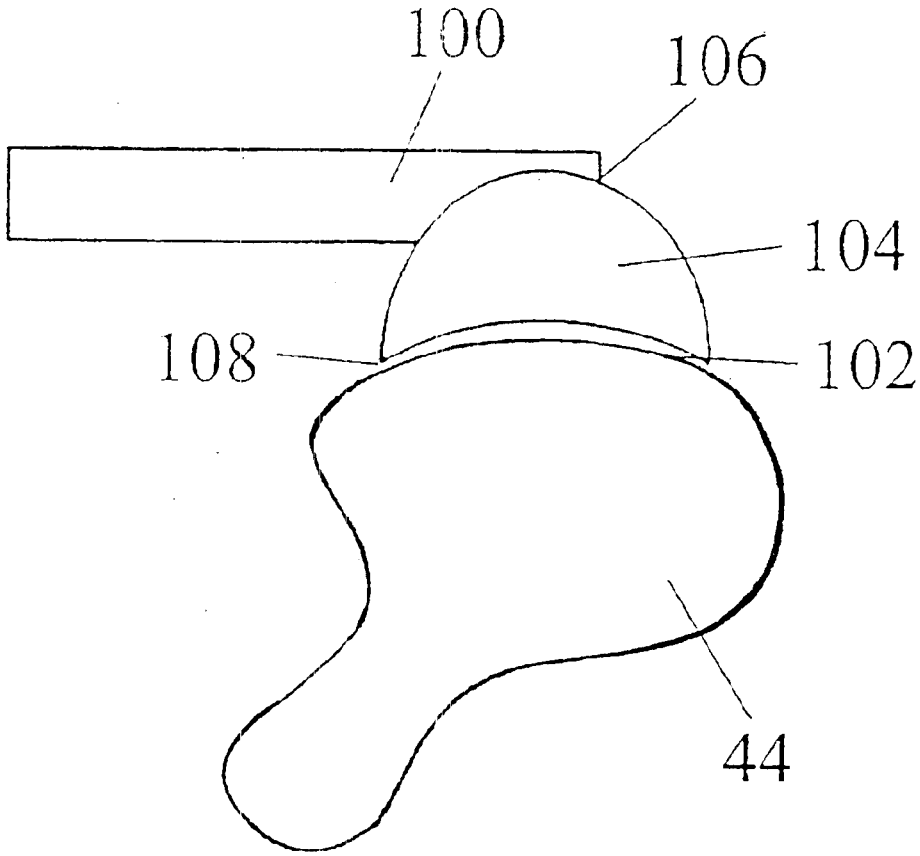
FIG. 3 is a perspective view of one embodiment of the present invention used with an input transducer.

As seen in FIG. 3, a first embodiment of the invention creates a coupling between the transducer, in this case a sensor transducer, and an ossicular element of middle ear 24, here the incus. However, the transducer may similarly be coupled with the malleus or a driver transducer may be coupled to the stapes. Typically, the transducer is mounted to a temporal bone such as the mastoid, but may also be mounted in the middle ear. This mounting may be accomplished in any way suitable for using the transducer with an implantable or semi-implantable hearing assistance device and is not part of the present invention. If desired, the transducer may be mounted with an adhesive. Alternately, a transducer support assembly may be used. Further, any suitable transducer figuration may be used. Generally, an electromechanical transducer is desired when the transducer is to process vibrations from an ossicle and convert them to electrical signals or convert electrical signals to mechanical vibrations. However, the present invention is equally suitable with acoustic microphones (where an acoustic microphone is used for an input and an electromagnetic transducer coupled as herein disclosed is used for output), or an accelerometer (again, as a sensor). Similarly, the output could be a cochlear implant with a sensor transducer, coupled as described herein. Common transducers known in the art are piezoelectric and electromagnetic transducers. Preferred, but not required, is a piezoelectric sensor transducer having a piezoelectric element, or bimorph, positioned adjacent an ossicular element of middle ear, such as the incus.

The present invention provides a method for coupling the transducer to the ossicular element. In one embodiment, illustrated in FIG. 3, the transducer tip 100 is positioned such that it either lightly touches the ossicle, here incus 44, or is spaced between a fraction of a millimeter to a few millimeters above the ossicle. Generally, a slight spacing (for example, between ¼ and one millimeter) between the ossicle, incus 44, and the transducer tip 100 is preferred. The transducer tip 100 may be washed and suctioned such that its surface is as dry and clean as possible. If a non-compliant adhesive is used, it is preferred that the surface 102 of the ossicle (incus 44) be coated with a thin layer of solution. The solution is preferably applied in sufficient amount to cover the surface to be in contact with the adhesive. The solution may be any substance that inhibits bonding between the adhesive and the ossicle. For example, the solution may be Ringer's solution, Ringer's Lactate, dextrose solution, simulated body fluid, any suitable aqueous solution, water, blood, any suitable body fluid, or any other suitable solution. These examples are meant to be illustrative and not limiting. It may be desirable, but is not necessary, to clean and suction the surface 104 of the ossicle before the solution is applied thereto. The method by which the solution is applied is not particularly important. One suitable method is to apply the solution with a liquid delivery system such as a tuberculin syringe with a fine needle. Further, in some situations, the fluid naturally occurring on the ossicle may be sufficient such that no additional solution needs to be applied.

An adhesive material 104, either non-compliant or compliant, is applied to the space between the tip 100 and the ossicle (incus 44) to create the mechanical coupling between the transducer and the ossicle. The adhesive may be applied using, for example, a pick or a syringe. The adhesive may be applied directly to the ossicle (incus 44) or to the transducer tip 100 or in any other manner such that the space therebetween is sufficiently filled with the adhesive material 104 to create a mechanical coupling between the transducer and the ossicle. A preferred non-compliant adhesive material is a glass ionomer cement such SerenoCem or BioCem (manufactured by Corinthian Medical) or OTO-CEM or Ionocem (manufactured by Ionos). If a glass ionomer cement is used, water at the ossicle/adhesive interface removes the ions necessary for chemical bonding to the ossicle. Alternatively, the adhesive may be a calcium phosphate cement, bone dust fibrin glue, blood, or alternative biocompatible adhesives (such as those based on silicone, cyanoacrylate, ethylene glycol, collagen, albumin, glutaraldehyde, methyl methacrylate, or other surgical adhesives) may be used. If fibrin glue or blood is used, it may be desirable to mix the glue or blood with bone dust. Again, the stated adhesive materials are for illustrative purposes only. A preferred compliant adhesive material is a silicone medical adhesive. Any suitable adhesive material may be used and the material most suited to the invention will vary depending on the solution used to coat the ossicle.

Figure 7:
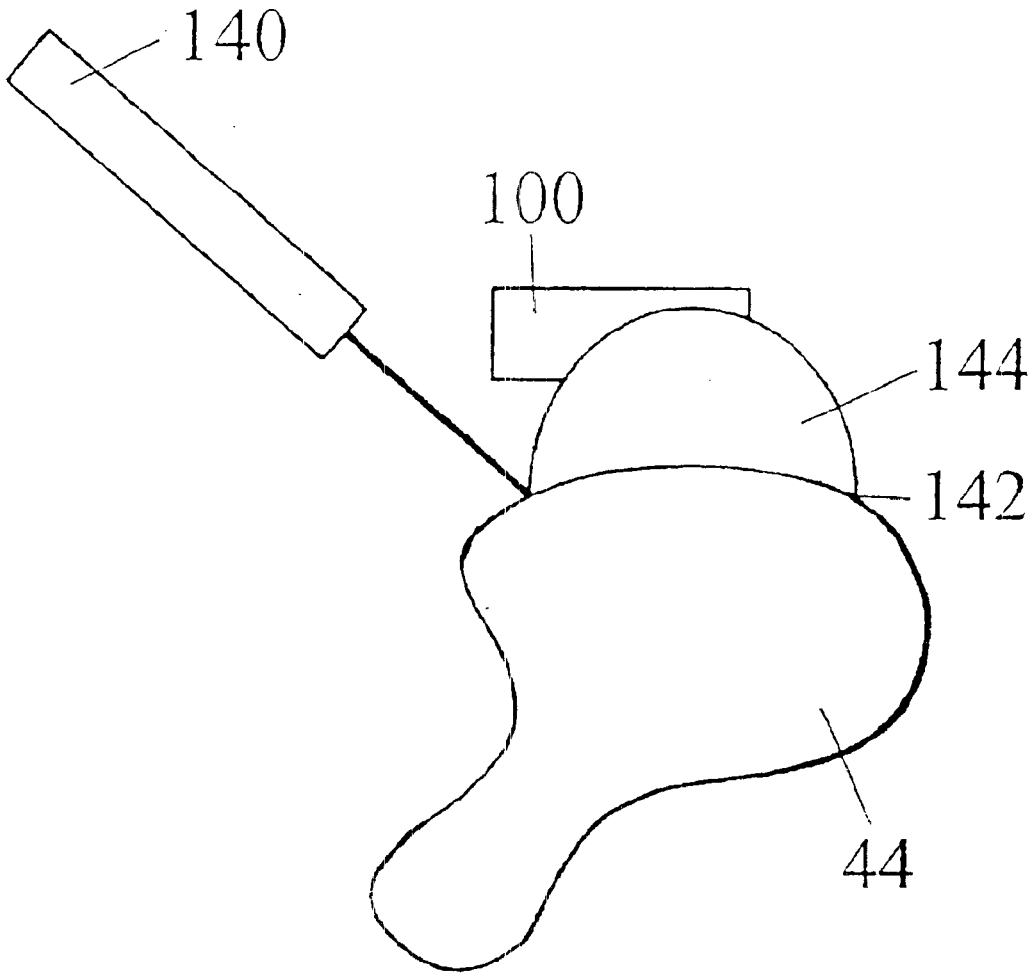
FIG. 7 illustrates an embodiment of the present invention involving breaking an adhesive bond.

Using a non-compliant adhesive, the adhesive material should be suited to create a hard bond at its interface 106 with the transducer tip 100 because the dry surface of the tip 100 allows mechanical and/or chemical bonding thereto. However, the thin layer of solution on the surface 102 of the ossicle should prevent the adhesive 104 from forming a mechanical or chemical bond at the interface between the ossicle and the adhesive. Thus, a microscopic space 108 is created at the ossicle/adhesive interface. For example, when glass powder and polymer are mixed, neutralization of the basic powder and the acidic polymer occurs. This process extracts ions, primarily cations, from the powder. Typically, the ions will react with the anion on the polymer to form crosslinks. However, because the ions are extracted, the crosslinks are not formed. These ions are also involved in forming chemical bonds with bone and metal. If water or other aqueous solution is present, it washes away the ions at that interface. The material molds itself to the shape of the surface, but the ions are not available to form crosslinks and chemical bonds. The layer of solution further inhibits good mechanical bonding. Thus, if any mechanical bonding is present, it can easily be broken by applying light pressure (as illustrated in FIG. 7).

Because the formation of a bond at the ossicle/adhesive interface is prevented, the coupling does not inhibit the natural motion of the ossicle. Thus, the adhesive attached to the tip molds to the shape of the ossicular surface and thereby forms a molded coupling that allows slip between the transducer tip and the ossicle and provides a neutral load.

If any bonding does occur between the ossicle and the transducer tip, the bond may be broken by gently separating the transducer tip and the ossicle. Optionally, the bond may be broken by separating the cement from the ossicle.

Alternately, using a compliant adhesive provides adequate sound transmission while providing good flow and adhesion characteristics for implantability. Small positional changes in the ossicle relative to the prosthesis are absorbed in the compliant adhesive joint. The absorption of the displacement allows the ossicle to maintain a near neutral bias.

Figure 4:
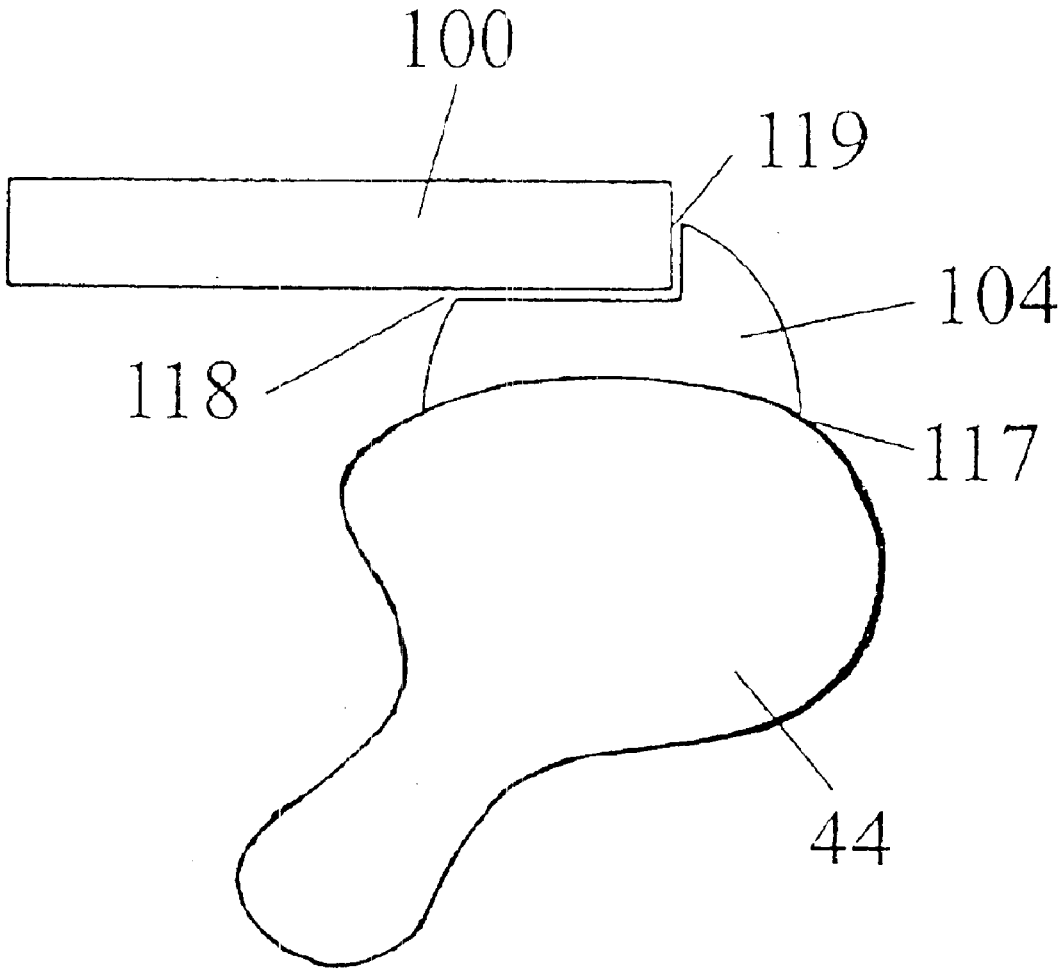
FIG. 4 is a perspective view of another embodiment of the present invention used with an input transducer.

FIG. 4 depicts an alternate embodiment of the invention wherein the ossicle (incus 44) is washed and suctioned to be as clean as possible and the solution is applied to the transducer tip 100. An adhesive material 104 is again applied between the ossicle and the transducer tip. Mechanical and/or chemical bonding occurs at the interface 117 between the ossicle and the adhesive material but does not occur at the interface 119 between the transducer tip and the adhesive material. Instead, a microscopic space is produced at the adhesive/transducer tip interface 119.

Figure 5:
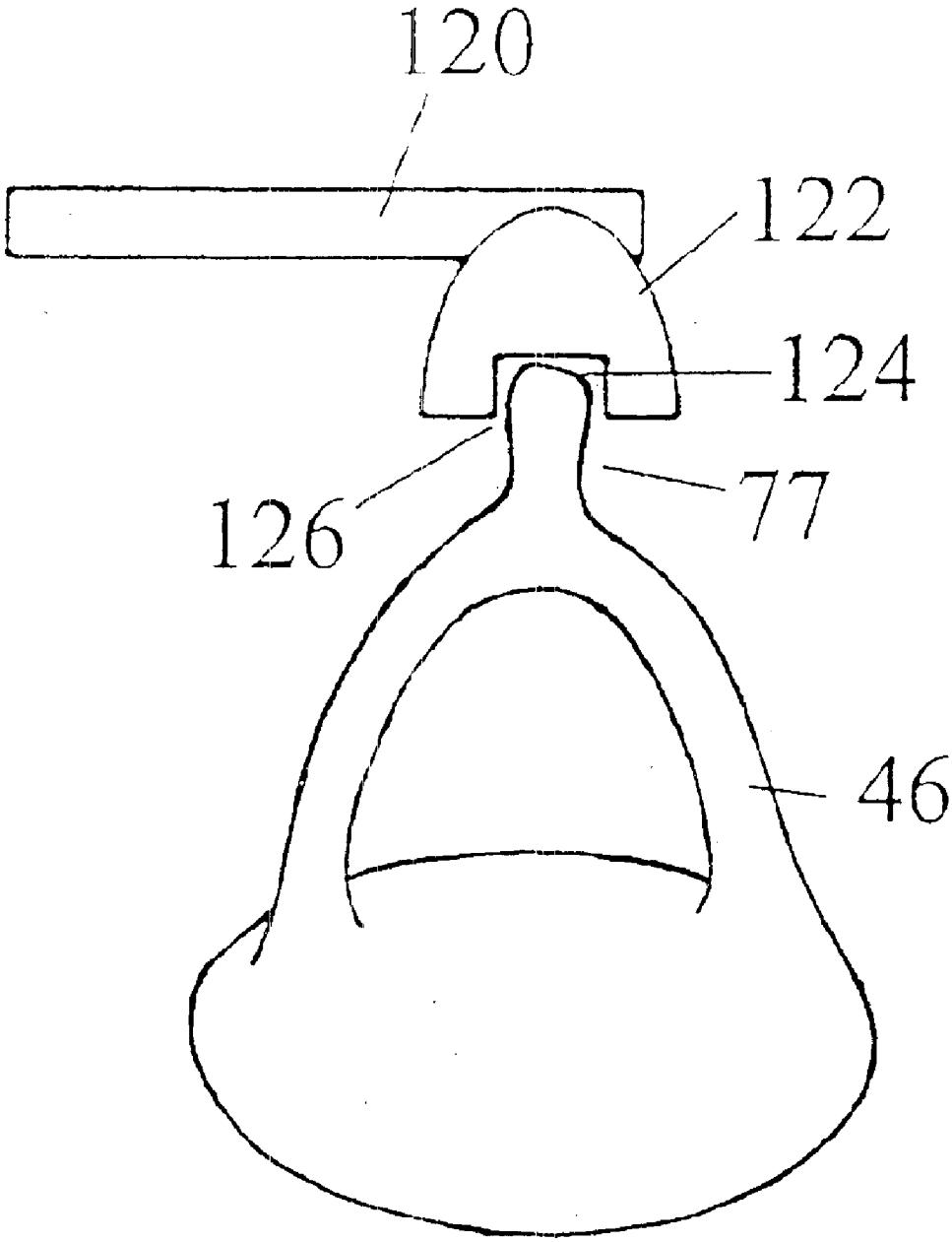
FIG. 5 is a perspective view of an embodiment of the present invention used with an output transducer.

As seen in FIG. 5, the invention may also be used to create a coupling between an output transducer and an ossicle of the middle ear, here the stapes 46. As before, it is desirable to clean and suction either the surface of the transducer tip 120 or the ossicular surface and to apply a thin layer of solution to the non-cleaned surface. An adhesive 122 is applied in the space between the ossicle (stapes 46) and the transducer tip 120. A mechanical and/or chemical bond is prevented from forming between the solution covered surface and the adhesive while such a bond is permitted between the cleaned surface and the adhesive. In FIG. 5, the fluid is applied to the surface 124 of the head 77 of the stapes 46. As a result, a microscopic space forms at the ossicle/adhesive interface.

Figure 6:
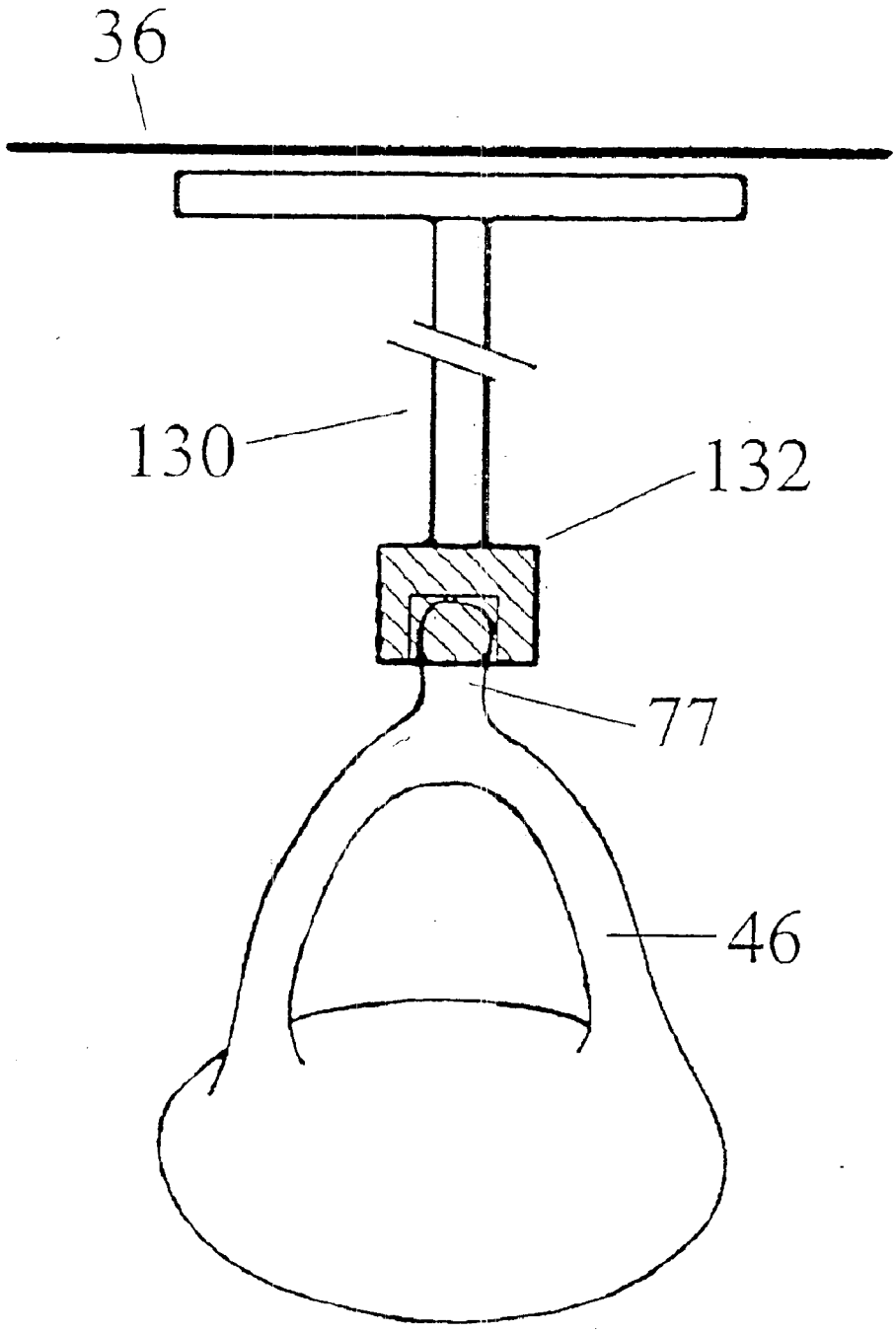
FIG. 6 is a perspective view of an embodiment of the present invention used with a passive prosthesis.

The method provided is not exclusive to either an input transducer or an output transducer but may be used with both in the same hearing assistance device. Further, the method may be used with any device wherein it is desirable to create a coupling that permits slip between the device and the structure to which it is coupled and also provide a neutral load while maintaining the benefits of hard fixation. For example, FIG. 6 illustrates a further embodiment where a coupling is created between an ossicular element, here the stapes 46, and a prosthesis such as a Partial Ossicular Replacement Prosthesis (PORP) 130 placed between the eardrum 36 and the stapes 46. The surface of the prosthesis is cleaned and suctioned while the ossicular surface is coated with a thin layer of solution. With a PORP, generally a part of the prosthesis formed as a bell 132 is filled with an adhesive and placed over the stapes head 77. Thus, the adhesive material is applied to the space between the ossicle and the prosthesis by filling the bell 32 with adhesive, thereby creating a coupling when the bell is fit over the stapes head 77. A mechanical and/or chemical bond is prevented between the ossicle and the adhesive but, if any adhesion does occur, may be removed by gently separating the prosthesis and the ossicle. Alternately, of course, the surface of the prosthesis may coated with a thin layer of solution while the ossicular surface is cleaned and suctioned.

As seen in FIG. 7, a surgical pick 140, or other suitable instrument, may be used to break any bond formed at the interface 142 between the adhesive 144 and the ossicle, here the incus 44. This may be preferred when sufficient body fluid exists on the ossicle prior such that no further solution need be applied. In such situation, although a weak bond may be formed, it may be broken as described.

In a further embodiment, a gel may be used in conjunction with a non-compliant adhesive to couple the device and the structure. Preferably, the gel is such that after bonding to the device, for example a transducer, the gel expands to encapsulate the structure, for example an ossicle, in a moist and humid environment. The gel may be a silicone, hydrogel, viscous fluid, or other synthetic or biological soft material. The thin gel coat and non-compliant adhesive provide adequate sound transmission while providing good flow and adhesion characteristics for implantability.

Figure 8:
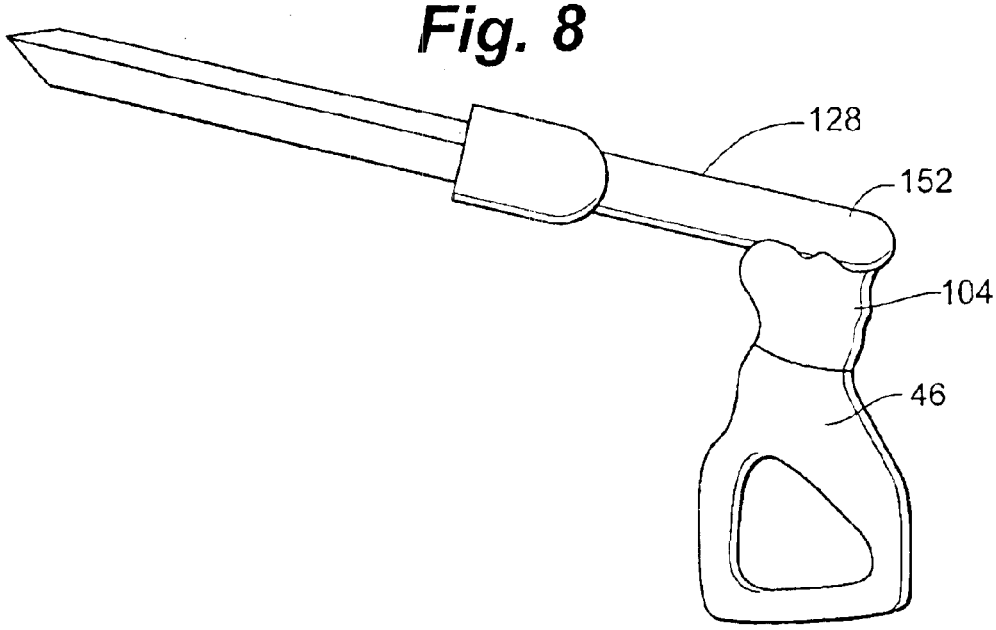
FIG. 8 is a perspective view of an embodiment of the present invention using a gel and a foil cover.
Figure 9:
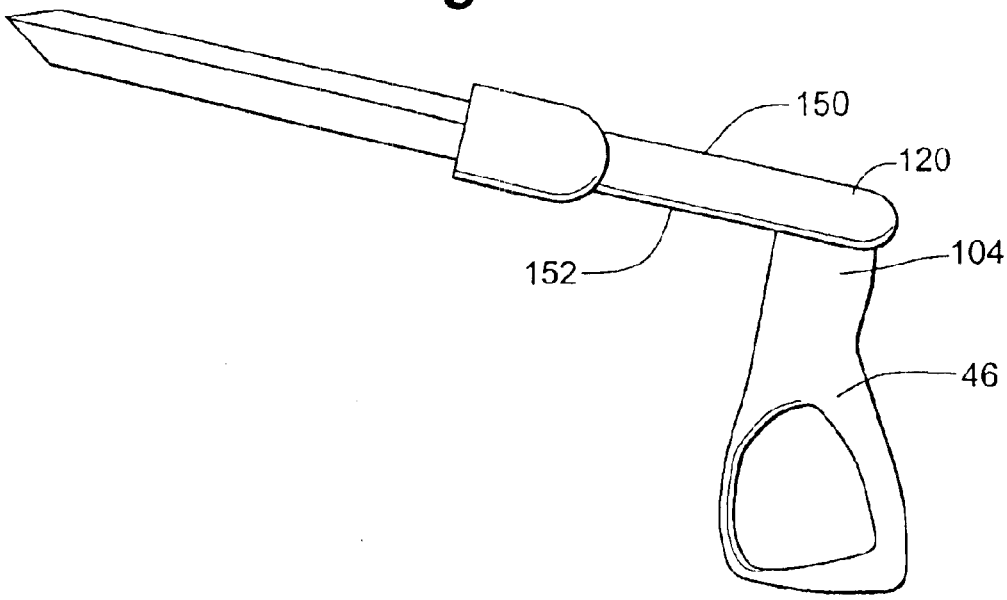
FIG. 9 is a cross-sectional view of the embodiment of FIG. 8.

A soft mount transducer coupling is shown in FIGS. 8 and 9. FIG. 8 illustrates a perspective view of the coupling while FIG. 9 illustrates a cross-sectional view of the coupling. The coupling uses a compliant gel 150 that surrounds the device, here a transducer tip 120. The gel 150 is covered with a metallic foil 152 to permit bonding of the tip 120 to the structure, here the stapes 46, using a non-compliant or hard adhesive 104 (for example, OTO-CEM or SerenoCem). Alternate adhesives such as silicone, polymethylmethacrylate, cyanoacrylate, tissue adhesive, tissue sealant, or other may be used. The gel 104 accommodates small changes in transducer-stapes position and maintains a near-neutral bias of the annular ligament. In an alternate embodiment, the gel 104 is not covered with a metallic foil.

In accordance with the present invention, the gel may be applied at alternative site, such as between the body of a transducer and a prosthesis pin. Any site where the gel accommodates changes in device-structure (for example, transducer-stapes) position is acceptable.

While the present invention has been described with reference to particular embodiments, the invention is not limited to the specific examples given. Various other modifications will occur to those of ordinary skill, and other embodiments and modifications may be made by those skilled in the art without departing from the spirit and scope of the invention as defined in the following claims.

What is claimed is:

1. A method for creating a coupling in an implantable device for the ear, the method comprising the steps of:

providing a device for coupling to a structure of the ear;

positioning the device proximate the structure;

cleaning the surface of the device;

coating the surface of the device with a gel;

applying an adhesive between the device and the structure;

allowing the adhesive to cure.

2. The method of claim 1, further including the step of covering the gel with a metallic foil.

3. The method of claim 1, wherein the adhesive is bone dust mixed with fibrin glue.

4. The method of claim 1, wherein the adhesive is blood.

5. The method of claim 1 wherein the adhesive is a biocompatible cement.

6. The method of claim 1, further including the step of cleaning and suctioning the surface of the structure before coating.

7. The method of claim 1, wherein the gel is a silicone.

8. The method of claim 1, wherein the gel is a hydrogel.

9. The method of claim 1, wherein the gel is a viscous fluid.

10. The method of claim 1, wherein the device is a transducer.

11. The method of claim 1, wherein the device is a prosthesis.

12. The method of claim 1, wherein the structure is an ossicle.

13. The method of claim 1, further including the step of separating the structure and the device to break any bonding that has occurred.

14. The method of claim 1, wherein step of positioning the device further includes positioning the device a distance of between ¼ and ½ mm from the structure.

15. The method of claim 1, wherein step of positioning the device further includes positioning the device a distance of between ¼ and 1 mm from the structure.

16. The method of claim 1, further including the step of coating the surface of the structure with a thin layer of solution before the step of applying an adhesive between the device and the structure.

17. The method of claim 16, wherein the solution is an aqueous solution.

18. The method of claim 16, wherein the solution inhibits bonding between the adhesive and the structure.

19. A method for creating a coupling in an implantable hearing assistance device, the method comprising the steps of:

providing a transducer having a transducer tip configured for contact with an ossicle extending therefrom;

positioning the transducer tip proximate an ossicle of the middle ear;

cleaning a surface of the transducer tip;

coating the surface of the transducer tip with a gel;

applying an adhesive between the transducer tip and the ossicle; and allowing the adhesive to cure.

20. The method of claim 19, further including the step of covering the gel with a metallic foil.

21. The method of claim 19, wherein the adhesive is blood.

22. The method of claim 21, further including the step of mixing the blood with bone dust.

23. The method of claim 19 wherein the adhesive is a biocompatible cement.

24. The method of claim 19, further including the step of cleaning and suctioning the surface of the ossicle before coating.

25. The method of claim 19, further including the step of separating the ossicle and the transducer tip to break any bonding that has occurred.

26. The method of claim 19, wherein step of positioning the transducer tip further includes positioning the transducer tip a distance of between ¼ and 1 mm from the ossicle.

27. The method of claim 19, wherein the transducer is an input transducer.

28. The method of claim 27, wherein the ossicle is a malleus.

29. The method of claim 27, wherein the ossicle is an incus.

30. The method of claim 19, wherein the transducer is an output transducer.

31. The method of claim 19, wherein the ossicle is a stapes.

32. The method of claim 19, further including the step of mounting the transducer to the mastoid.

33. The method of claim 19, further including the step of coating the surface of the ossicle with a thin layer of solution before the step of applying an adhesive between the transducer tip and the ossicle.

34. The method of claim 33, wherein the solution is naturally occurring on the surface of the ossicle.

35. A method for creating a coupling in an implantable transducer for the ear, the method comprising the steps of:

providing the transducer having a tip configured for contact with a structure of the ear;

positioning the transducer tip proximate the structure;

cleaning a surface of the transducer tip;

applying a compliant adhesive between the transducer tip and the structure; and allowing the adhesive to cure.

* * * * *